US011814763B2

(12) United States Patent
Klinzing et al.

(10) Patent No.: US 11,814,763 B2
(45) Date of Patent: Nov. 14, 2023

(54) MACHINES SYSTEMS AND METHODS FOR MAKING RANDOM FIBER WEBS

(71) Applicant: 3M INNOVATIVE PROPERTIES COMPANY, St. Paul, MN (US)

(72) Inventors: William P. Klinzing, West Lakeland, MN (US); Warren D. Eaton, St. Paul, MN (US); Jon A. Lindberg, Prairie du Chien, WI (US); David C. Raithel, Hudson, WI (US); Kyle J. Baumgartner, Strawberry Point, IA (US); James C. Breister, Oakdale, MN (US); Joseph A. Dunbar, Woodbury, MN (US); Blake R. Griffith, Oakdale, MN (US); Cristobal Martin Bernia, Madrid (ES); Jesse R. Seifert, New Richmond, WI (US); Joshua D. Tibbits, Eagan, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 17/250,594

(22) PCT Filed: Aug. 8, 2019

(86) PCT No.: PCT/US2019/045603
§ 371 (c)(1),
(2) Date: Feb. 8, 2021

(87) PCT Pub. No.: WO2020/033616
PCT Pub. Date: Feb. 13, 2020

(65) Prior Publication Data

US 2021/0348317 A1 Nov. 11, 2021

Related U.S. Application Data

(60) Provisional application No. 62/717,069, filed on Aug. 10, 2018.

(51) Int. Cl.
*D04H 1/732* (2012.01)
*D01G 15/20* (2006.01)
*D01G 15/46* (2006.01)

(52) U.S. Cl.
CPC ..... *D04H 1/732* (2013.01); *D01G 15/20* (2013.01); *D01G 15/465* (2013.01)

(58) Field of Classification Search
CPC ..... D01G 15/20; D01G 15/465; D01G 15/40; D04H 1/72; D04H 1/732
(Continued)

(56) References Cited

U.S. PATENT DOCUMENTS 2,890,497 A * 6/1959 Marks ..... D04H 1/72 19/303
3,748,693 A * 7/1973 Jespersen ..... D04H 1/732 425/82.1

(Continued)

FOREIGN PATENT DOCUMENTS

DE 10321283 A1 * 12/2004 ..... D01G 15/465
WO WO 1988-05838 8/1988

(Continued)

OTHER PUBLICATIONS

International Search Report for PCT International Application No. PCT/US2019/045603, dated Nov. 18, 2019, 5 pages.

*Primary Examiner* — Aiying Zhao
(74) *Attorney, Agent, or Firm* — Katherine M. Scholz

(57) ABSTRACT

Methods apparatuses and systems of forming a random fiber web using pneumatic fiber feeding system are disclosed. In one embodiment, a method can optionally comprise: providing a plurality of moveable apparatuses including a lickerin and a feeder, the lickerin configured to remove a plurality of fibers from a fibrous mat delivered to adjacent the lickerin by the feeder; doffing the plurality of fibers from the lickerin at a doffing location within the system; com- (Continued)

municating an air supply to entrain the plurality of fibers with the air supply after the doffing; and collecting the plurality of fibers from the air supply to form the random fiber web.

11 Claims, 9 Drawing Sheets

(58) Field of Classification Search
USPC ..... 19/105, 106 R, 109, 296
See application file for complete search history.

(56) References Cited

U.S. PATENT DOCUMENTS 3,768,119 A * 10/1973 Wood ..... D04H 1/72 19/306
3,918,126 A * 11/1975 Wood ..... D21H 15/06 264/518
3,972,092 A * 8/1976 Wood ..... D01G 25/00 425/82.1
3,982,302 A 9/1976 Vaalburg
4,004,323 A 1/1977 Gotchel
4,097,965 A 7/1978 Gotchel
4,240,180 A * 12/1980 Wood ..... D01G 23/02 19/105
4,375,447 A 3/1983 Chang
4,375,448 A 3/1983 Appel
4,388,056 A 6/1983 Lee
4,403,374 A 9/1983 Wood
4,514,880 A * 5/1985 Vaughn ..... D04H 1/4242 19/0.35
4,640,810 A 2/1987 Laursen
4,812,283 A * 3/1989 Farley ..... B29C 70/443 264/518
4,952,128 A 8/1990 Marshall et al.
6,939,492 B2 9/2005 Jackson
2004/0134355 A1 * 7/2004 Kasmark, Jr. ..... B01D 39/2055 96/154
2007/0056674 A1 3/2007 Sellars
2009/0056091 A1 3/2009 Jezzi

FOREIGN PATENT DOCUMENTS

WO WO 2009-089579 7/2009
WO WO 2020-033617 2/2020

* cited by examiner

MACHINES SYSTEMS AND METHODS FOR MAKING RANDOM FIBER WEBS

CROSS REFERENCE TO RELATED APPLICATIONS

This application is a national stage filing under 35 U.S.C. 371 of PCT/US2019/045603, filed Aug. 8, 2019, which claims the benefit of U.S. Provisional Application No. 62/717,069, filed Aug. 10, 2018, the disclosure of which is incorporated by reference in its/their entirety herein.

BACKGROUND

The present disclosure relates to methods, systems and machines for forming random fiber webs. More particularly, it relates to machines, systems and methods for creating non-woven air-laid webs.

In general, various machines, systems and methods are known for making random fiber webs for random fiber articles that are used for various purposes. Cleaning and abrading apparatuses are partially formed of random fiber webs. Additionally, disposable absorbent products such as mortuary, veterinary and personal care absorbent products such as diapers, feminine pads, adult incontinence products, and training pants often include one or more layers of random fiber web materials, especially liquid absorbent fiber web materials.

SUMMARY

Aspects of the present disclosure are directed toward machines, systems and methods of making non-woven air-laid webs. One known machine 10 for creating a non-woven air-laid web is shown in reference to FIG. 1. Such machine 10 relies on an initial random fiber mat that is fed to a rotating lickerin 12 such as by a feed roll 14. The lickerin 12 is configured to comb individual fibers from the initial random fiber mat (not shown in FIG. 1). The lickerin 12 then doffs the combed fibers therefrom using centrifugal force and the combed fibers enter an air supply AS flowing past the lickerin 12 and a saber roll 16. The doffed fibers are carried entrained in the air supply AS to a condenser 18. The fibers are deposited on the condenser 18 in a random fashion to form the non-woven fiber web (not shown in FIG. 1).

Unfortunately, the above described machine often has a non-uniform deposition of the fibers on the condenser 18. This has led to further costly processing steps to create a more uniform web deposition. For example, with the machine of FIG. 1, portions of the non-woven fiber web such as along the cross-web edge regions thereof may be removed due to the non-uniform deposition of the fibers on the condenser 18.

The present inventors have recognized machines which modify the machine of FIG. 1 to provide for a more uniform deposition of the fibers on the condenser. Such machines reduce processing costs and can reduce the need for further post deposition steps. One realization of the present inventors was the machine of FIG. 1 was doffing an undesirable amount of the combed fibers against one or both of a doffer plate 20 and a lower slide plate 22. These fibers were not being entrained in the air supply AS and clumped together rolling down one or both of the doffer plate 20 and the lower slide plate 22 to the condenser 18. This was suspected as one cause of the non-uniform deposition discussed above. In response, the present inventors propose various solutions, machines and the like, including those with the doffer plate and/or the lower slide plate being removed or having a modified geometry with respect to the machine of FIG. 1.

The present inventors have also realized other components and machine embodiments that allow for an improved more uniform deposition of the fibers on the condenser. These components variously include the addition of a seal having a reverse orientation relative to a direction of rotation of the condenser, one or more ports in a housing of the machine that allow for viewing of the doffing of the fibers and/or lay-up of the fibers on the condenser, addition of a nose bar and/or nose bar extension that changes the doffing point of the fibers into the air stream, the addition of various air venting passages in the housing, a doffer plate and/or the lower slide plate configured to facilitate venting and/or air intake into and/or out of the air supply to name but a few. Further components and machines embodiments are disclosed herein and discussed with reference to the FIGURES.

Various embodiments are disclosed and include a method of forming a random fiber web using pneumatic fiber feeding system is disclosed. The method can optionally comprise: providing a plurality of moveable apparatuses including a lickerin and a feeder, the lickerin configured to remove a plurality of fibers from a fibrous mat delivered to adjacent the lickerin by the feeder; doffing the plurality of fibers from the lickerin at a doffing location within the system; communicating an air supply to entrain the plurality of fibers with the air supply after the doffing; and collecting the plurality of fibers from the air supply to form the random fiber web.

In another embodiment, a pneumatic fiber feeding system for forming a random fiber web is disclosed. The system can optionally comprise: a rotatable feed roll; a rotatable lickerin roll configured to remove a plurality of fibers from a fibrous mat delivered to adjacent the lickerin roll by the feed roll and configured to doff the plurality of fibers from the lickerin roll; a rotatable saber roll positioned adjacent the teed roll and the lickerin roll; a channel communicating an air supply to a space defined between the lickerin roll and the saber roll, the space including a doffing location where the doff of the plurality of fibers from the lickerin roll occurs; and a collector positioned to capture the plurality of fibers once doffed into the air supply, the plurality of fibers forming the random fiber web on the collector.

In another embodiment, a pneumatic fiber feeding system for forming a random fiber web is disclosed. The system can optionally comprise: a plurality of moveable apparatuses including a lickerin and a feeder, the lickerin configured to remove a plurality of fibers from a fibrous mat delivered to adjacent the lickerin by the feeder, wherein the lickerin is configured to doff the plurality of fibers from the lickerin; a channel communicating an air supply to a space adjacent the lickerin, the space including a doffing location where the doff of the plurality of fibers from the lickerin occurs; a collector positioned to capture the plurality of fibers once doffed into the main air supply, the plurality of fibers forming the random fiber web on the collector; and at least one of: a nose bar assembly positioned at least partially between the feed roll and the lickerin and extending into the space, a vent in a saber roll assembly adjacent the lickerin and communicating with the air supply, a seal coupled to the plate at a mounting portion and extending to contact the collector, wherein the seal extends from the mounting portion to a tip in a direction opposing the direction of rotation of the collector, or one or more viewing ports along the channel including adjacent one or more of the doffing location and the collector.

DETAILED DESCRIPTION

Figure 1:
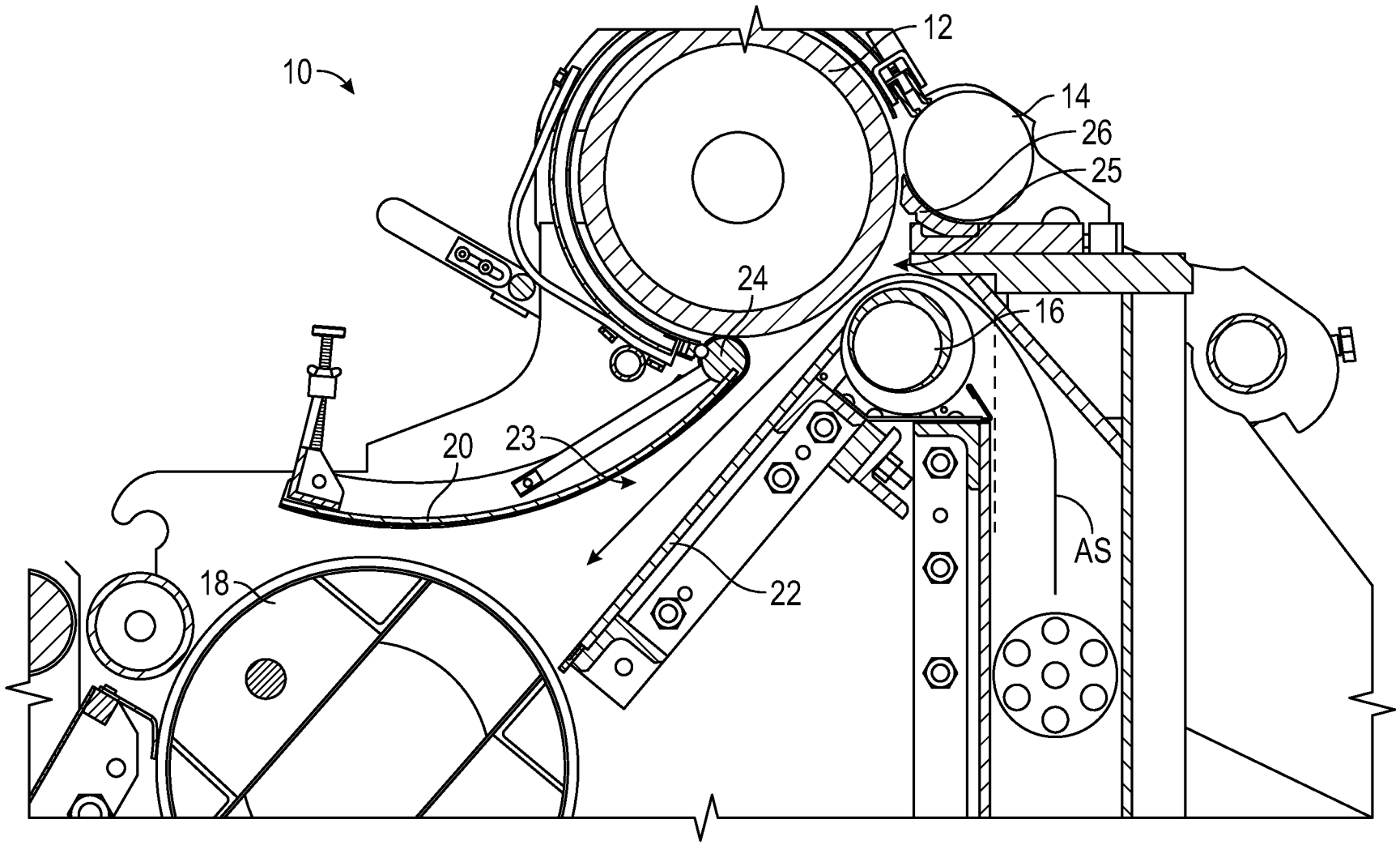
FIG. 1 (Prior Art)
FIG. 1 is a schematic cross-section of a portion of a machine for forming a random fiber web as is known in the prior art.

Aspects of the present disclosure relate to machines, systems and methods for manufacturing random fiber webs. As a point of reference, FIG. 1 illustrates portions of the known machine 10 for forming a random fiber web and has been previously discussed in reference to the summary above. In such machine 10, the webs are suitable for producing non-woven fabrics by known chemical or mechanical bonding treatments. For example, dry formed structures may be chemically bonded by known means such as the application of adhesives by spray or by saturation, also bonding may be accomplished by the use of fibers, which can have a low melting point and form a bond to non-adhesive fibers by heat and pressure. Mechanical bonding may be carried out by needling, stitch bonding, print bonding or the like. The quality of any non-woven fabric produced by these finishing methods depends upon the quality and uniformity of the web structure which is to be treated or finished.

Still referring to FIG. 1, the processes described herein can be run at high volume. For example, with the machine 10 doffed fibers can be projected at an initial velocity of up to 5,000 feet per minute by the lickerin 12, which can rotate at the same velocity. Velocities of up to 20,000 feet per minute are not uncommon for the lickerin 12. Doffed fibers can entrain with the air supply AS passing adjacent the lickerin 12. The air supply AS, with the dotted fibers entrained therein, passes from adjacent the lickerin 12 into a chamber 23 that is partially defined by the doffer plate 20 and the lower slide plate 22. These two plates typically have an angle of less than 15° initially. However, the doffer plate 20 and the lower slide plate 22 are angled relative to one another such that the chamber 23 increases in its cross-section from adjacent the lickerin to adjacent the condenser 18. The air supply AS can be controlled so that the doffed fibers are projected into air supply AS with an average velocity of the air flow in the air supply AS being between 0.5 and 1.5 times the initial fiber velocity. The doffed fibers are preferably projected onto the condenser 18 at a rate of between 3 and 30 pounds per hour per inch of machine width or air flow width, although the machine 10 can be suitable for slower and higher rates of operation. Large volumes of air are typically used as the air supply AS to convey the doffed fibers to the condenser 18. Operating with 20 to 30 times weight of air to weight of fiber processed per unit of time, at standard conditions of density and temperature (0.075 lbs. per cu. ft. at 70° F. and 29.92" Hg) is typical.

It is desired that the air supply AS have uniform velocity, low turbulence, with a stable air stream, free from vorticities, in the direction of movement of the lickerin 12. Unfortunately, such is not always the case with machine 10. It was previously thought with the design of the channel/chamber that convey the air supply AS should be shaped to create a venturi 25 in the region adjacent the lickerin 12 where the fibers are doffed upstream of the chamber 23. Furthermore, a boundary layer which is formed around the surface of the lickerin 12 can be interrupted by the use of a doffing bar 24, which is situated adjacent the chamber 23 at a point of maximum shear just below the lickerin 12 at the start of the chamber 23 (sometimes called the expansion chamber). The doffing bar 24 is configured to provide a controlled low level of turbulence in the air supply AS through which the doffed fibers pass.

A nose bar 26 can be utilized and positioned at a small distance from the surface of the lickerin 12 to provide a narrow passage where the fibers are carried on hooks, projections or pieces of the wire covering or a cylinder surface of the lickerin 12 to a point of projection (called a doffing point or doffing location) into the venturi 25 and the air supply AS. The saber roll 16 can be positioned adjacent the nose bar 26 and the lickerin 12 and can be positioned in and adjacent the air supply AS. The saber roll 16 can be journaled for eccentric movement in the side housings of the machine 10. The saber roll 16 spreads the flow of the air supply AS and aids in doffing the fibers from the lickerin 12. The eccentric mounting of the saber roll 16 allows of varying the space between the lickerin 12 and the saber roll 16 so as to restrict the air supply AS to the doffing location.

As discussed above, the present inventors have recognized components which modify the machine 10 of FIG. 1 to provide for a more uniform deposition of the fibers on the condenser. More particularly, the present inventors recognized with the machine 10 of FIG. 1, the doffing location and doffing trajectory is undesirable, and typically leads to a non-uniform deposition of the fibers on the condenser 18 due to at least some of the fibers being doffed toward and contacting the doffer plate 20 and/or the lower slide plate 22 and becoming jumbled and entangled together. Furthermore, the present inventors recognized the machine 10 of FIG. 1 is susceptible to turbulent airflow, air flow surges and/or vortices due to factors including a fully enclosed expansion chamber and fully enclosed other portions of a channel that communicates the air supply AS within the machine 10. The use of the venturi 25 at and just after the doffing location was also determined by the present inventors to be unnecessary in all embodiments. The present inventors also recognize modifications to the expansion chamber geometry, and indeed, in some cases elimination or modification of the doffer plate 20 and/or the lower slide plate 22 can be desirable.

Figure 2:
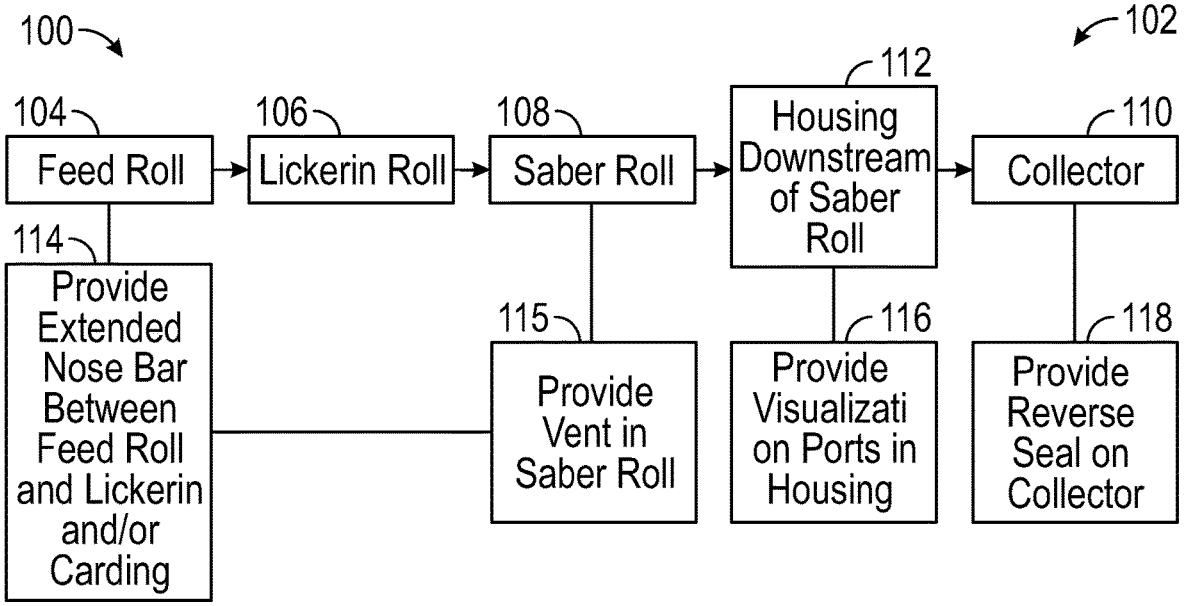
FIG. 2 is a high level schematic diagram tracking some modifications and/or additional components to a system for forming a random fiber web according to an embodiment of the present disclosure.

FIG. 2 shows a highly schematic method 100 of forming a random fiber web using a pneumatic fiber feeding system 102. The method can include providing a plurality of rotatable rolls. These rotatable rolls can include a feed roll 104, a lickerin roll 106, and a saber roll 108. The term "roll" as used herein is broadly defined to mean any of a moveable, driven or feed type apparatus such as a belt, and is therefore not limited only to rotatable apparatuses such as a roll. The lickerin roll 106 can be configured with hooks, projections and/or other features to remove a plurality of fibers from a fibrous mat delivered to adjacent the lickerin roll by the feed roll 104. The saber roll 108 can be moveably positioned adjacent (within less than an inch to a few inches of) the lickerin roll 106.

The method 100 can include doffing the plurality of fibers from the lickerin roll at a doffing location within the system 102. The method 100 can further include communicating an air supply to entrain the plurality of fibers with the air supply after the doffing. Additionally, the method 100 can include collecting the plurality of fibers from the air supply to form the random fiber web. Such collection of the fibers can occur at a collector 110 (also call a condenser). The collector can comprise a moveable apparatus such as a roll or belt that can move to gather the laid-up fibers to form the new random fiber web as they fall to the collector 110.

The air supply AS with the plurality of fibers entrained therein can pass through a channel (also called a chamber, space or volume herein) that is downstream (in terms of a direction of flow of the air supply AS) from adjacent the lickerin roll 106 and the saber roll 108. This channel can extend from adjacent the lickerin roll 106 and the saber roll 108 to adjacent the collector 110. The channel can be at least partially defined by a housing 112 (this housing 112 can include the doffer plate, the lower slide plate, and/or the side housings as previously described herein).

As has been previously discussed and will be further discussed herein subsequently, the present inventors have modified the method 100 and the system 102 from the method and machine of FIG. 1. FIG. 2 shows just some system and component modifications that the present inventors contemplate. These modifications and components are further described in reference to FIGS. 3-11. Further components and modifications are discussed in co-pending application No. 62/717,095 entitled "MACHINES SYSTEMS AND METHODS FOR MAKING RANDOM FIBER WEBS" filed on the even day with the present application the entire disclosure of which is incorporated by reference herein its entirety.

Figure 3:
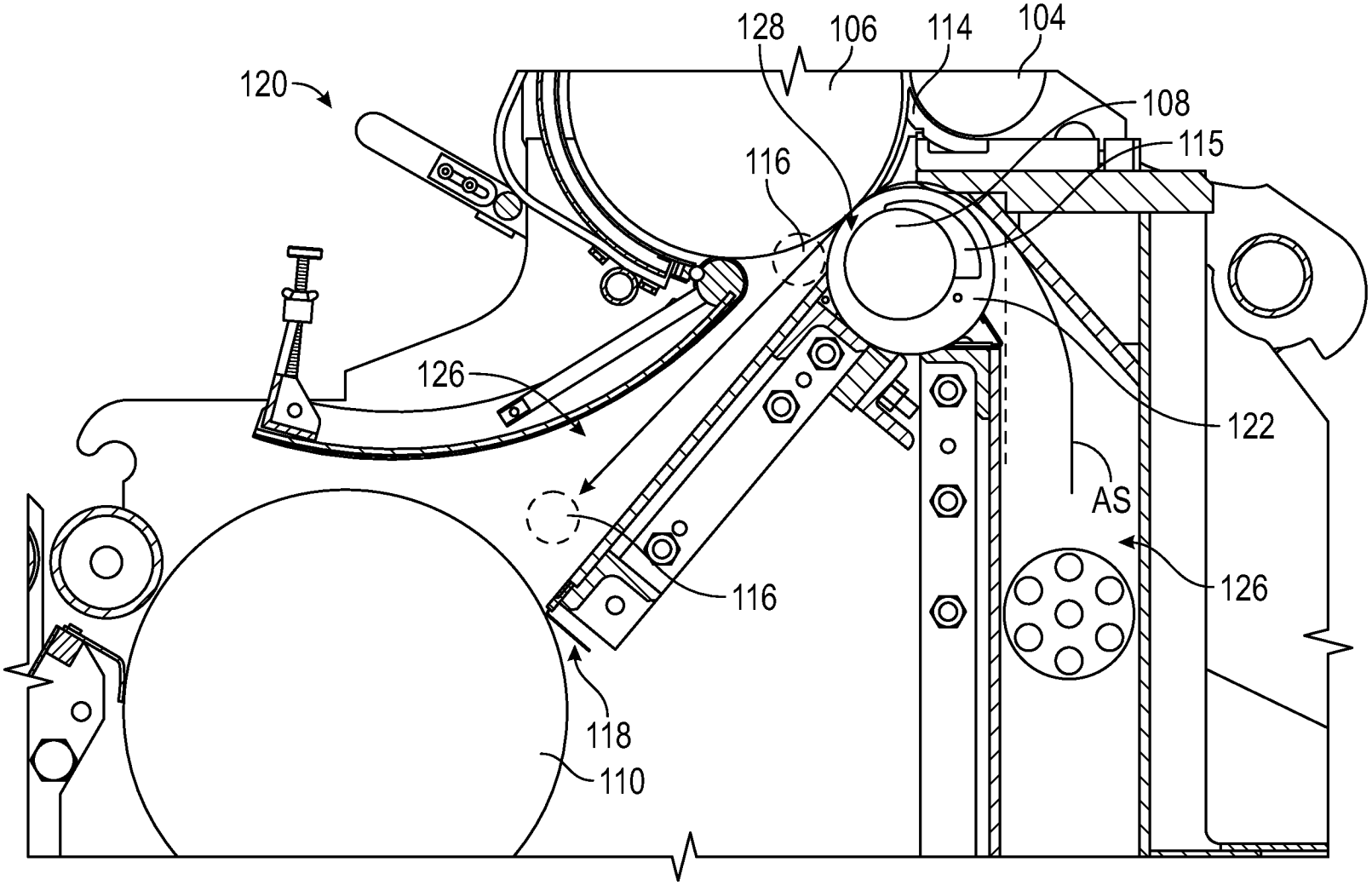
FIG. 3 is a schematic cross-section of a portion of a first machine for forming a random fiber web according to an embodiment of the present disclosure.

Specifically, FIG. 2 illustrates four possible additions to the method 100 and the system 102 that can be utilized. These additions can be utilized together (as shown in FIG. 3), alone or in various combinations. Such additions can include providing for a nose bar assembly 114 that can include an extended nose bar between the feed roll 104 and the lickerin roll 106. The nose bar assembly 114 can have texturing (i.e. can include surface features such as from carding wires, etc.) in some embodiments. The method 100 and system 102 can include providing for a vent 115 in a saber roll assembly (i.e. a vent between the saber roll 108 and a saber roll end cap that is rotatably mounted in the side housing). The method 100 and system can include providing one or more viewing ports 116 in the housing 112. These one or more viewing ports 116 can be positioned adjacent the doffing location (e.g., adjacent the lickerin roll 106) and adjacent the collector 110, for example. These viewing ports allow for viewing/monitoring of the doffing of the fibers and/or viewing/monitoring of the fibers as they fall and form the random fiber web on the collector 110, for example. Additionally, the method 100 and system 102 can provide a reverse seal 118 that engages the collector 110 and further is mounted to the lower slide plate. This reverse seal 118 can be shaped to extend from the lower slide plate and can be oriented with a tip that extends in a direction generally opposite of a direction of rotation of the collector 110.

FIG. 3 shows the four additions discussed in reference to the system 102 and method 100 of FIG. 2 utilized together in a machine 120 having an air supply AS. As was discussed in FIG. 2, in FIG. 3 the machine 120 can include a feed apparatus (e.g., rotatable feed roll 104), a lickerin (e.g., lickerin roll 106) a saber (e.g., the saber roll 108), a channel 126 including a space 128 and the collector 110. The rotatable lickerin roll 106 can be configured to remove a plurality of fibers from a fibrous mat delivered to adjacent the lickerin roll 106 by the feed roll 104. The lickerin roll 106 can be configured to doff the plurality of fibers from the lickerin roll 106. The rotatable saber roll 108 can be positioned adjacent the feed roll 104 and the lickerin roll 106. The channel 126 can communicate the air supply AS to the space 128 defined between the lickerin roll 106 and the saber roll 108. The space 128 can include a doffing location where the doff of the plurality of fibers from the lickerin roll 106 occurs. The rotatable collector 110 can be positioned to capture the plurality of fibers once doffed into the air supply AS. The plurality of fibers when laid-up form the random fiber web on the collector 110.

Figure 4:
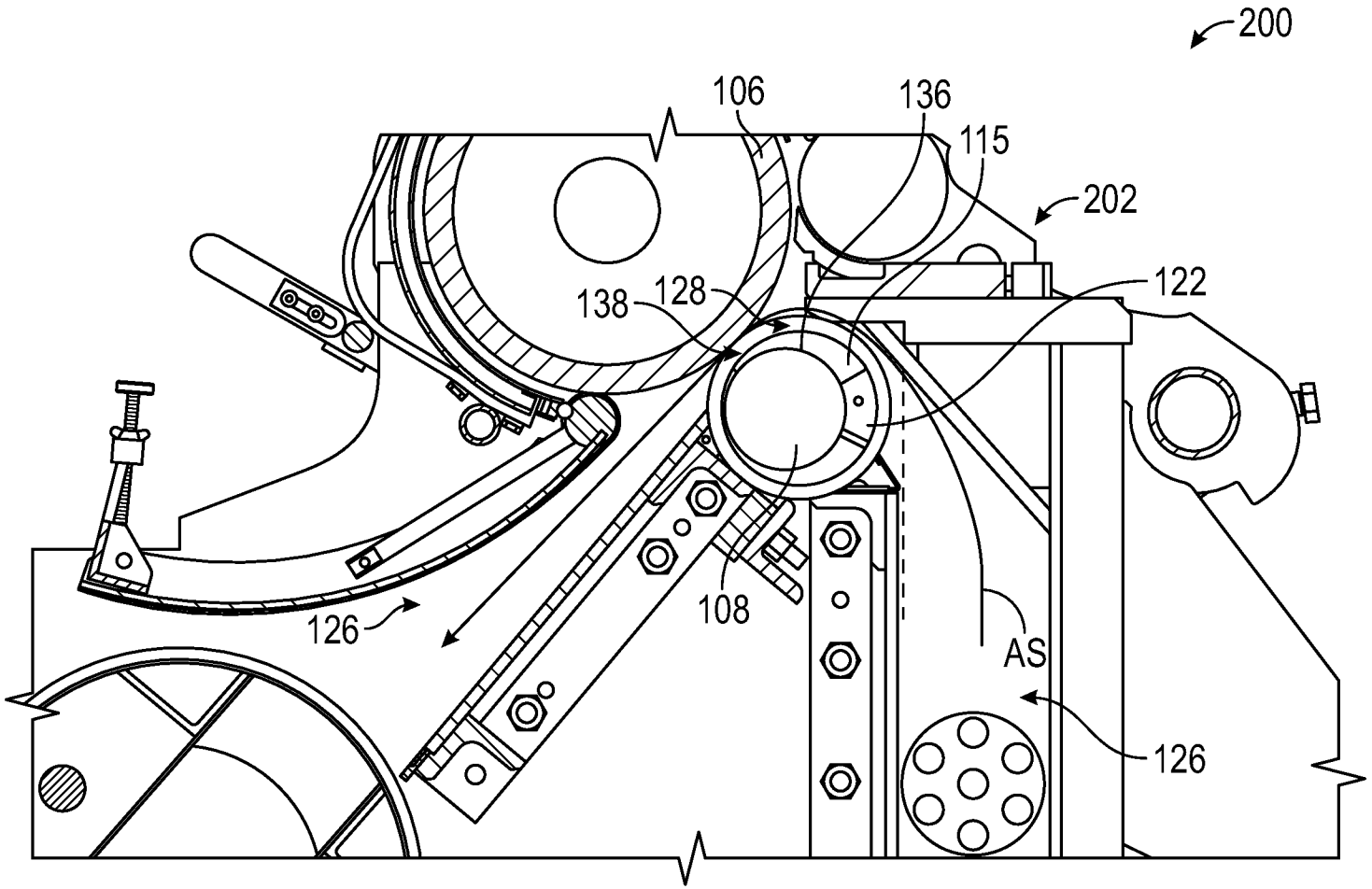
FIG. 4 is a schematic cross-section of a portion of a second machine for forming a random fiber web according to an embodiment of the present disclosure.
Figure 5:
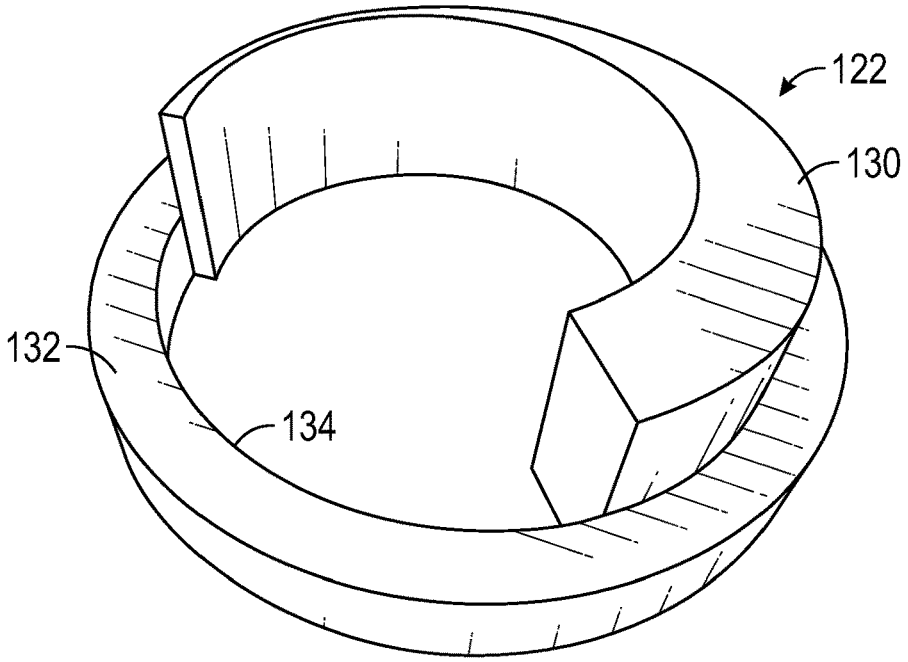
FIG. 5 is a perspective view of an end cap for a saber roll according to an embodiment of the present disclosure.

The embodiment of FIG. 3 shows the nose bar assembly 114 positioned adjacent the lickerin roll 106 and extending along the lickerin roll 106 toward the saber roll 108 for the machine 120. FIG. 3 additionally shows the vent 115 in the saber roll end cap 122 adjacent the lickerin roll 106 for the machine 120. As the saber roll end cap 122 can be moveable in the side housing, the position of the vent 115 can change relative to the lickerin roll 106. FIG. 3 shows the one or more viewing ports 116 in the side housing of the machine 120. The one or more viewing ports 116 can be positioned adjacent the doffing location (e.g., adjacent the lickerin roll 106) and adjacent the collector 110. The apparatus 120 can include the reverse seal 118 that is shaped to extend from the lower slide plate 124 to engage with the collector 110. The reverse seal 118 can be oriented with a tip that extends generally in a direction opposite of a direction of rotation of the collector 110.

t Ki. 4 shows a system 200 that is part of a machine 202 that includes only the vent 115 as previously described. FIG. 5 shows a perspective view of the saber roll end cap 122. The vent 115 can be defined by the saber roll end cap 122 and the saber roll 108. The position of the vent 115 can change relative to the lickerin roll 106 as the saber end cap 122 and the saber roll 108 can be moveable relative to the lickerin roll 106. In particular, the saber end cap 122 is configured to eccentrically positioning the saber roll 108 within the space 128. As shown in the embodiment of FIG. 4, the vent 115 communicates with the channel 126 such that an amount of the air supply AS can pass therethrough and/or an amount of ambient air from outside the machine 202 side housing can pass therethrough into the channel 126. The vent 115 provides communication of an amount of air from the air supply AS to the ambient or communication of an amount of ambient air into the air supply AS as operating conditions dictate. The present inventors have found that use of the vent reduces turbulent airflow within the channel 126 including the space 128. Additionally, by venting at or adjacent the saber end cap 122, the cross-web deposition of the plurality of fibers can be more uniform especially along the edges of the web formed by the machine 202.

As shown in FIG. 5, a first portion 130 of the saber roll end cap 122 can be configured to receive and support the saber roll 108 (FIG. 4). A second portion 132 of the saber roll end cap 122 can define a first edge 134 of the vent 115. Returning to FIG. 4, a second edge 136 of the vent 115 can be defined by the saber roll 108 outer diameter, in some cases. As shown in FIG. 4, the vent 115 can be shaped as a tapered slot 138 having an increasing cross-sectional area along a length thereof in a direction of rotation of the saber roll 108 and the saber roll end cap 122. The length of the tapered slot 138 can be between 0 degree and 170 degrees of a circumference of the saber roll 108 in some embodiments. In further embodiments, the tapered slot 138 can have an extend of between 60 degrees and 160 degrees of the circumference of the saber roll 108. The slot 138 can have taper from 0 inch width on a first end to about 3 inches of width on the second end. In yet further embodiments, the taper may not be as aggressive and may only be from 0 inch width on a first end to about 1 inch of width on the second end.

Figure 6:
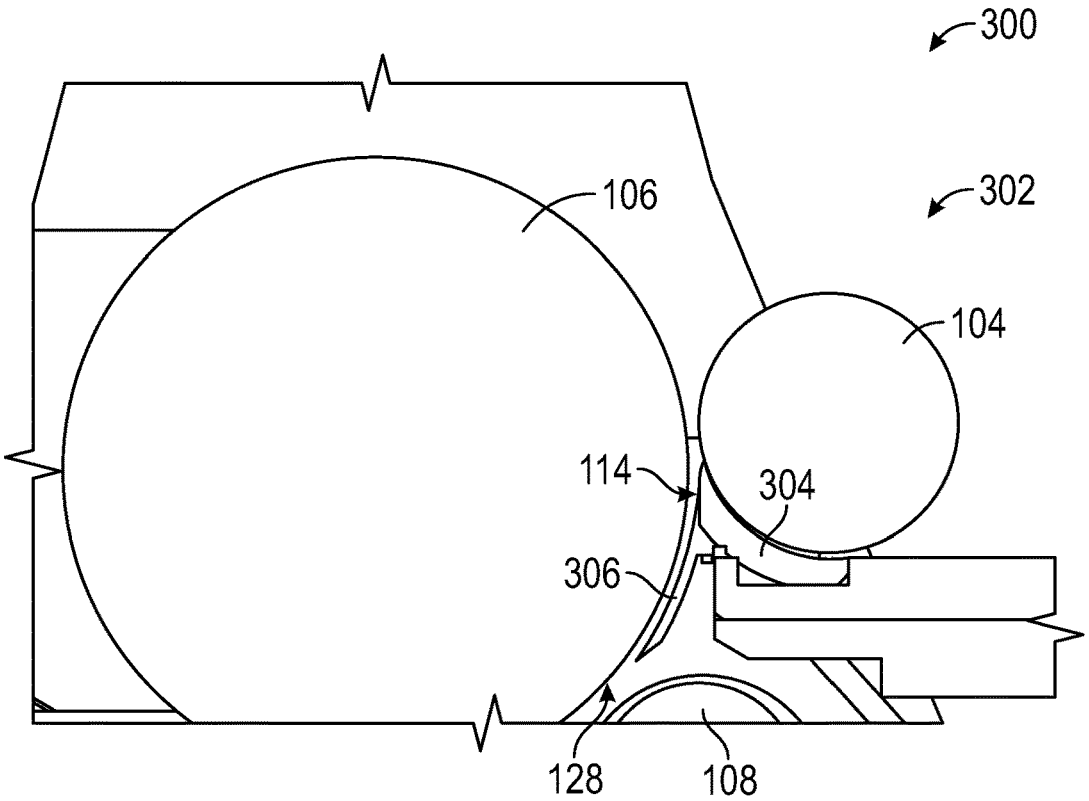
FIG. 6 is an enlarged schematic cross-section showing a lickerin and a nose bar assembly of a third machine for forming a random fiber web according to an embodiment of the present disclosure.

FIG. 6 shows the nose bar assembly 114 part of a system 300 that is part of a machine 302. The nose bar assembly 114 can be positioned adjacent the lickerin roll 106 and can extend along the lickerin roll 106 toward the saber roll 108 for the machine 302. More particularly, the nose bar assembly 114 can include a nose bar 304 and a nose bar extension 306. The nose bar extension 306 and the nose bar 304 can be coupled together. The nose bar extension 306 can extend along the lickerin roll 106 and toward the saber roll 108 and can extend into the space 128 defined between lickerin roll 106 and the saber roll 108 such that the doffing location is in the air supply AS in the space 128. The nose bar assembly 114, and in particular, the nose bar extension 306 can control the doffing location (i.e., the location where the plurality of fibers are doffed from the lickerin roll 106) and trajectory. The nose bar extension 306 is shaped such that the doffing location and trajectory is shifted so the plurality of fibers clear the doffer plate 20 and the lower slide plate 22 (refer to FIG. 1) and are better positioned to entrain in the air supply AS.

According to the embodiment of FIG. 6, the nose bar assembly 114 is positioned at least partially between the feed roll 104 and the lickerin roll 106 and extends into the space 128. The nose bar assembly 114 can be positioned adjacent to (within a few inches of) and can extend around a circumference of the lickerin roll 106 from 1 degree up to 170 degrees. In further embodiments, the nose bar assembly 114 can extend around the circumference of the lickerin roll 106 between 1 degree and 70 degrees. In yet further embodiments, the nose bar assembly 114 can extend around the circumference of the lickerin roll 106 between 1 degree and 32 degrees.

Figure 7:
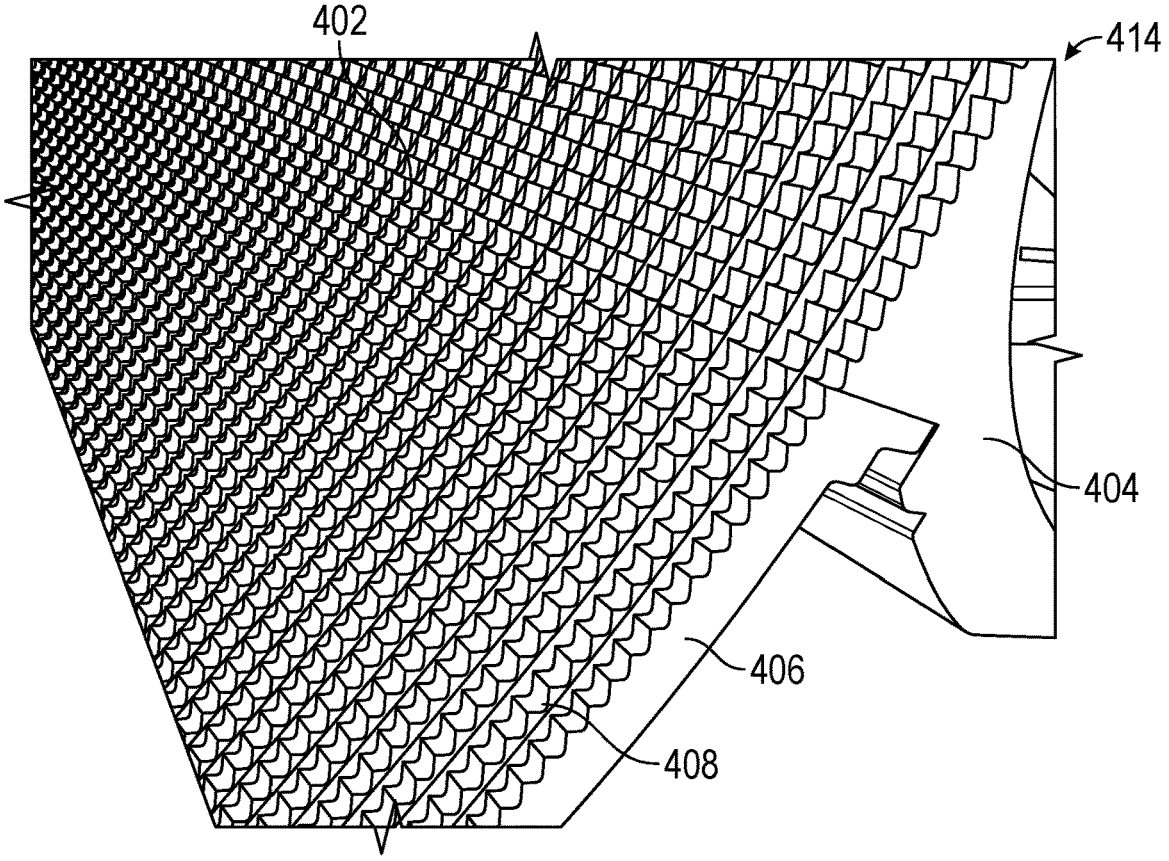
FIG. 7 is a perspective view of the nose bar assembly of FIG. 6 according to an embodiment of the present disclosure.

FIG. 7 shows another embodiment of a nose bar assembly 414 that has a surface 402 that is configured to interface with the lickerin roll 106 (FIG. 6). The surface 402 can be formed by both a nose bar extension 406 and a nose bar 404 in the embodiment of FIG. 7. In the embodiment of FIG. 7, the surface has a texture 408 to encourage the separation of clumps of the plurality of fibers that have been captured/combed by the lickerin roll 106 (FIG. 6). Texture 408 may comprise, for example, a plurality of interruptions in the surface 402 (such as protruding and/or recessed features) configured to cause impact, redirection, and/or disentanglement of fibers as the fibers pass over the surface 402. In the example shown in FIG. 7, texture 408 includes a series of teeth, but it should be understood that such texture 408 could comprise any structure suitably adapted for the purposes described in this paragraph. Although both the nose bar extension 406 and the nose bar 404 are shown as having the texture 408 in FIG. 7, in other embodiments only one or portions of the nose bar extension 406 and the nose bar 404 surface 402 may have the texture 408. According to one embodiment, the depth of the texturing can be between 0.005 inch and 0.1 inch. In some embodiments the depth of the texturing can be between 0.005 inch and 0.2 inch.

Figure 8:
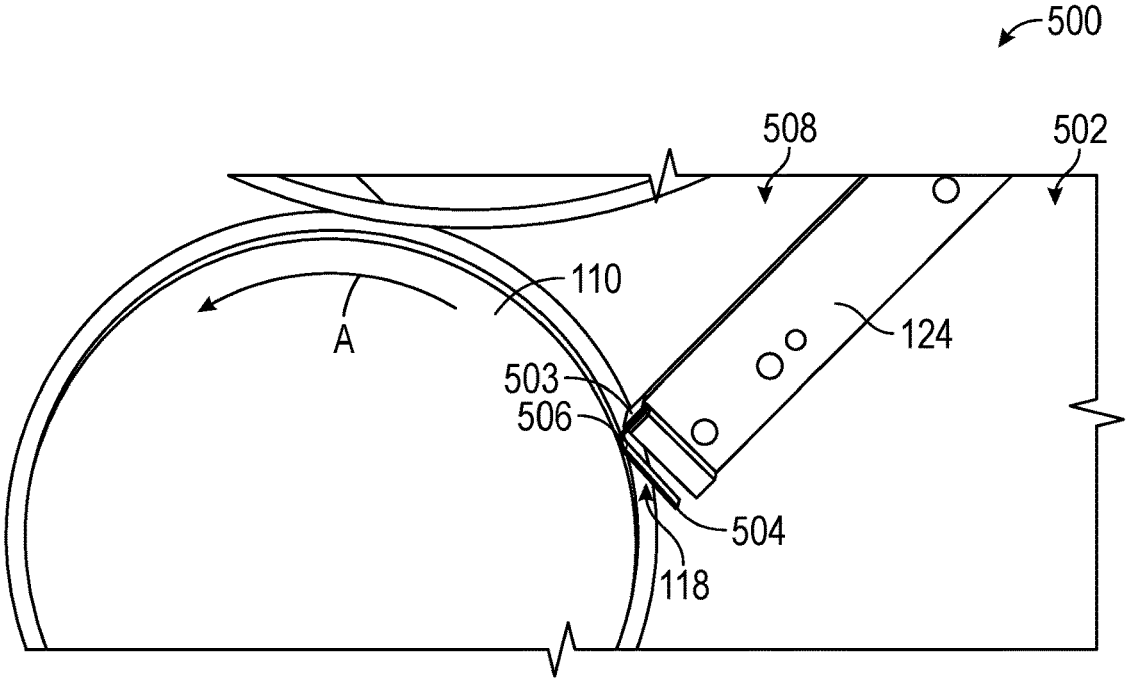
FIG. 8 is an enlarged schematic cross-section showing a condenser a seal and a lower slide plate of a fourth machine for forming a random fiber web according to an embodiment of the present disclosure.

FIG. 8 shows the reverse seal 118 as part of a system 500 that is part of a machine 502. The reverse seal 118 can be shaped to extend from the lower slide plate 124 to engage with the collector 110. The reverse seal 118 can mount to the lower slide plate 124 at a mounting portion 503. The reverse seal 118 can be oriented extending from the mounting portion to a tip 504 generally in a direction opposite of a direction of rotation (indicated with arrow A) of the collector 110. The reverse seal 118 can have a curved body portion 506 configured to engage the collector 110 along a surface thereof. Seal 118 is configured such that no surface projects into the chamber 508 partially defined by the lower slide plate 124, and indeed no portion of the reverse seal 118 projects above a surface of the lower slide plate 124. Such configuration for the reverse seal 118 eliminates or reduces the likelihood of the plurality of fibers landing on or being caught by the reverse seal 118. According to one embodiment, the reverse seal 118 can have length from the mounting portion 503 to the tip 504 of between 0.5 inch and 3.0 inches, inclusive.

Figure 9:
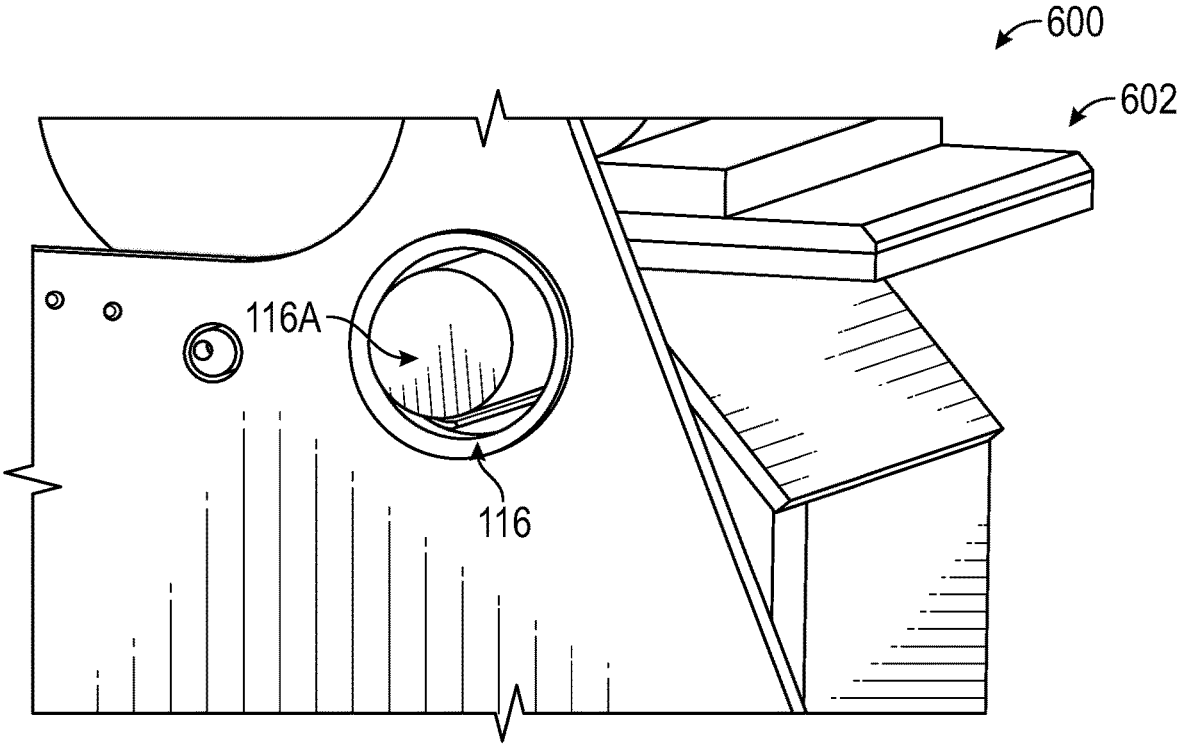
FIGS. 9-11 show one or more ports in a housing of a fifth machine forming a random fiber web according to an embodiment of the present disclosure.
Figure 10:
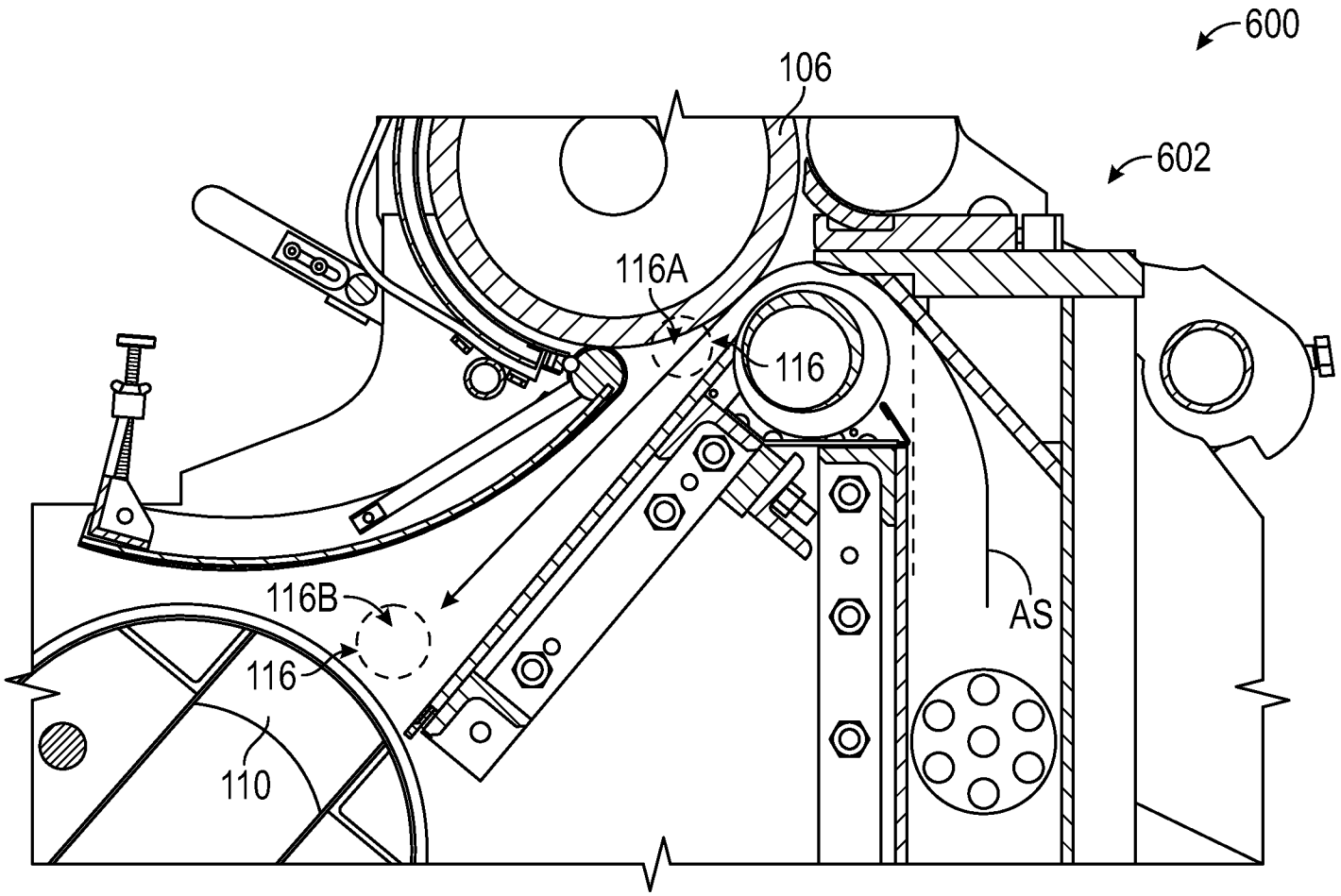
Figure 11:
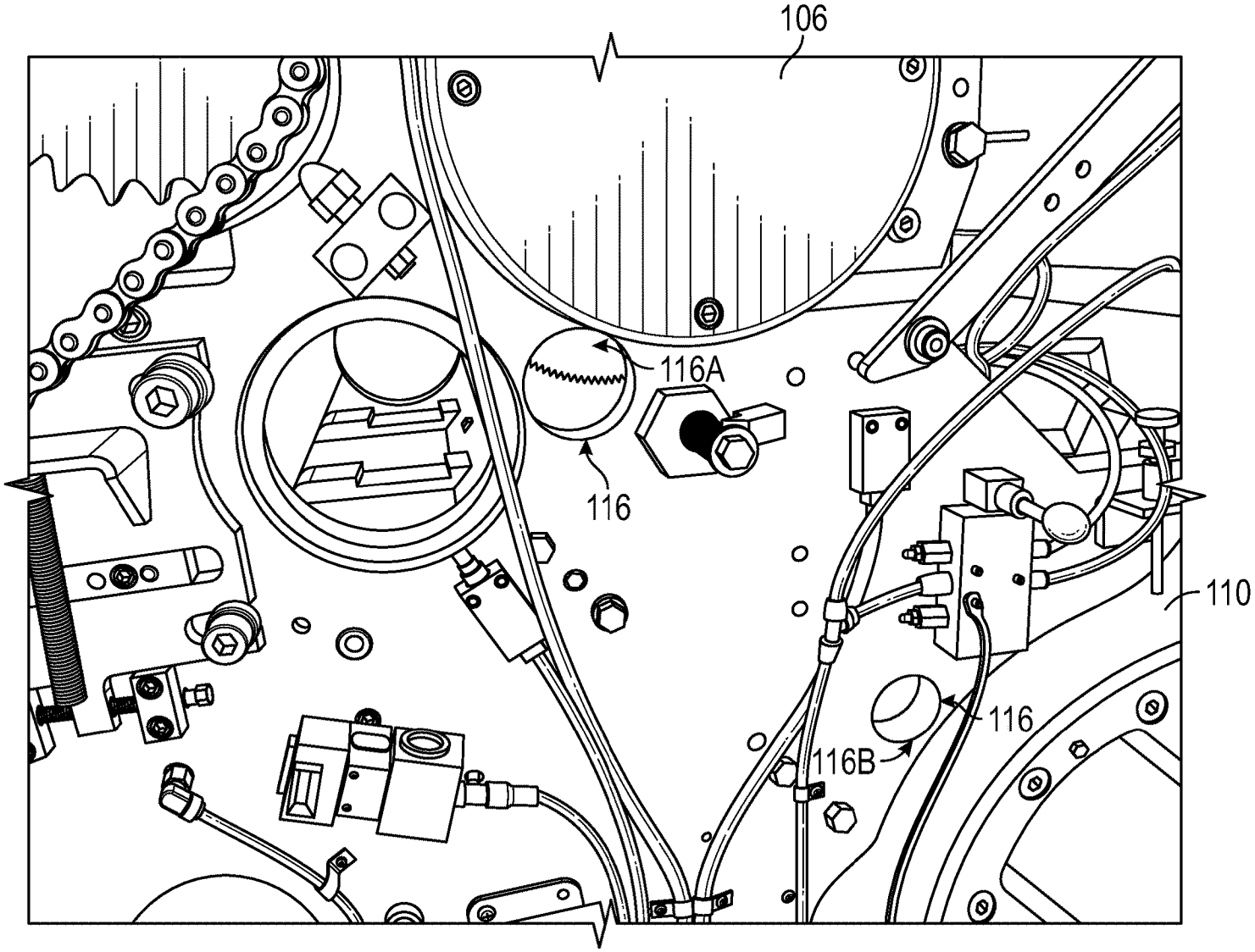

FIGS. 9, 10 and 11 show a system 600 that is part of a machine 602. The system 600 includes the one or more viewing ports 116 in a side housing 604 (shown in FIGS. 9 and 11) of the machine 602. The one or more viewing ports 116 can include a first viewing port 116A positioned adjacent the doffing location (e.g., adjacent the lickerin roll 106 in FIGS. 10 and 11) and a second viewing port 116B (FIGS. 10 and 11) positioned adjacent the collector 110 (FIGS. 10 and 11). The one or more viewing ports 116 can be used to monitor doffing of the plurality of fibers into the air stream AS (FIG. 10) and can be used to monitor lay-up of the plurality of fibers on the collector 110 (FIGS. 10 and 11). For example, cameras can be mounted to capture images through the viewing ports 116. The viewing ports 116 can have a thermoplastic sheet such as polycarbonate or another sheet of light transmissive material mounted therein to permit viewing but keep the air supply and the plurality of fibers within the machine 602.

As used herein:

The term "a", "an", and "the" are used interchangeably with "at least one" to mean one or more of the elements being described.

The term "and/or" means either or both. For example, "A and/or B" means only A, only B, or both A and B.

The terms "including," "comprising," or "having," and variations thereof, are meant to encompass the items listed thereafter and equivalents thereof as well as additional items.

The term "adjacent" refers to the relative position of two elements, such as, for example, two layers, that are close to each other and may or may not be necessarily in contact with each other or that may have one or more layers separating the two elements as understood by the context in which "adjacent" appears.

All scientific and technical terms used herein have meanings commonly used in the art unless otherwise specified. The definitions provided herein are to facilitate understanding of certain terms used frequently in this application and are not meant to exclude a reasonable interpretation of those terms in the context of the present disclosure.

Unless otherwise indicated, all numbers in the description and the claims expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviations found in their respective testing measurements.

The term "substantially" means within 20 percent (in some cases within 15 percent, in yet other cases within 10 percent, and in yet other cases within 5 percent) of the attribute being referred to. Thus, a value A is "substantially similar" to a value B if the value A is within plus/minus one or more of 5%, 10%, 20% of the value A.

Features and advantages of the present disclosure will be further understood upon consideration of the detailed description as well as the appended claims.

The recitation of numerical ranges by endpoints includes all numbers subsumed within that range (e.g. a range from 1 to 5 includes, for instance, 1, 1.5, 2, 2.75, 3, 3.80, 4, and 5) and any range within that range.

Although the present disclosure has been described with reference to preferred embodiments, workers skilled in the art will recognize that changes can be made in form and detail without departing from the spirit and scope of the present disclosure.

VARIOUS NOTES & EXAMPLES

In Example 1, a method of forming a random fiber web using pneumatic fiber feeding system is disclosed. The method can optionally comprise: providing a plurality of moveable apparatuses including a lickerin and a feeder, the lickerin configured to remove a plurality of fibers from a fibrous mat delivered to adjacent the lickerin by the feeder; doffing the plurality of fibers from the lickerin at a doffing location within the system; communicating an air supply to entrain the plurality of fibers with the air supply after the doffing; and collecting the plurality of fibers from the air supply to form the random fiber web.

In Example 2, the method of Example 1, can optionally further comprise providing for a nose bar assembly extending between a portion of the feeder and the lickerin and extending into the air supply adjacent the doffing location.

In Example 3, the method of Example 2, wherein the nose bar assembly can have texturing along a surface that interfaces with the lickerin.

In Example 4, the method of any one or any combination of Examples 1-3, can optionally further comprising providing for a vent in a saber roll assembly and communicating with the air supply.

In Example 5, the method of Example 4, wherein the vent can be moveable with movement of the saber roll assembly away from and toward the doffing location.

In Example 6, the method of any one or any combination of Examples 1-5, can optionally further comprise providing one or more viewing ports in the housing including adjacent one or more of the doffing location and a location of the collecting of the plurality of fibers.

In Example 7, the method of any one or any combination of Examples 1-6, can optionally further comprise providing a reverse seal mounted to a lower slide plate and engaging a collector that performs collecting of the plurality of fibers and further is mounted to the lower slide plate, wherein the reverse seal is oriented with an extent from a mounting portion to a tip that extends in a direction generally opposite of a direction of rotation of the collector.

In Example 8, a pneumatic fiber feeding system for forming a random fiber web is disclosed. The system can optionally comprise: a rotatable feed roll; a rotatable lickerin roll configured to remove a plurality of fibers from a fibrous mat delivered to adjacent the lickerin roll by the feed roll and configured to doff the plurality of fibers from the lickerin roll; a rotatable saber roll positioned adjacent the feed roll and the lickerin roll; a channel communicating an air supply to a space defined between the lickerin roll and the saber roll, the space including a doffing location where the doff of the plurality of fibers from the lickerin roll occurs; and a collector positioned to capture the plurality of fibers once doffed into the air supply, the plurality of fibers forming the random fiber web on the collector.

In Example 9, the system of Example 8, can optionally further comprise a nose bar assembly positioned at least partially between the feed roll and the lickerin roll and extending into the space.

In Example 10, the system of Example 9, wherein the nose bar assembly can wrap from 1 degree up to 170 degrees of the circumference of the lickerin roll.

In Example 11, the system of anyone or any combination of Examples 8-10, wherein the nose bar assembly can have a surface that interfaces with the lickerin roll, and wherein the surface has texturing to separate the plurality of fibers.

In Example 12, the system of anyone or any combination of Examples 8-11, wherein the nose bar assembly can be configured to extend the doffing location past the feed roll and into the space defined between lickerin roll and the saber roll.

In Example 13, the system of any one or any combination of Examples 8-12, wherein the saber roll can be coupled to a moveable end plate, the end plate configured for eccentrically positioning the saber roll within the space, and wherein the end plate includes a passage therein that communicates with the channel such that an amount of the supply air can pass therethrough or an amount of ambient air can pass therethrough into the channel.

In Example 14, the system of Example 13, wherein the passage can comprise a tapered slot having an increasing cross-sectional area along a length thereof in a direction of rotation of the saber roll and end plate, and wherein the length of the slot is between 1 degree and 170 degrees of a circumference of the saber roll.

In Example 15, the system of any one or any combination of Examples 8-14, can optionally further comprise: one or more plates extending between adjacent the saber roll to adjacent the collector; and a seal coupled to an end portion of the one or more plates at a mounting portion and extending to contact the collector, wherein the seal extends from the mounting portion to a tip in a direction opposing the direction of rotation of the collector.

In Example 16, the system of any one or any combination of Examples 8-15, further comprising one or more viewing ports along the channel including adjacent one or more of the doffing location and the collector.

In Example 17, a pneumatic fiber feeding system for forming a random fiber web is disclosed. The system can optionally comprise: a plurality of moveable apparatuses including a lickerin and a feeder, the lickerin configured to remove a plurality of fibers from a fibrous mat delivered to adjacent the lickerin by the feeder, wherein the lickerin is configured to doff the plurality of fibers from the lickerin; a channel communicating an air supply to a space adjacent the lickerin, the space including a doffing location where the doff of the plurality of fibers from the lickerin occurs; a collector positioned to capture the plurality of fibers once doffed into the main air supply, the plurality of fibers forming the random fiber web on the collector; and at least one of: a nose bar assembly positioned at least partially between the feed roll and the lickerin and extending into the space, a vent in a saber roll assembly adjacent the lickerin and communicating with the air supply, a seal coupled to the plate at a mounting portion and extending to contact the collector, wherein the seal extends from the mounting portion to a tip in a direction opposing the direction of rotation of the collector, or one or more viewing ports along the channel including adjacent one or more of the doffing location and the collector.

In Example 18, the system of Example 17, wherein the nose bar assembly can be configured to extend the doffing location past the feeder and into the space defined between lickerin and the saber roll assembly.

In Example 19, the system of any one or any combination of Examples 17-18, wherein the vent can be tapered having an increasing cross-sectional area along a length thereof in a direction of rotation of the saber roll assembly.

In Example 20, the system of any one or any combination of Examples 17-19, wherein the nose bar assembly can have a surface that interfaces with the lickerin roll, and wherein the surface has a texturing to separate the plurality of fibers.

What is claimed is:

1. A method of forming a random fiber web using a pneumatic fiber feeding system, the method comprising:

providing a plurality of moveable apparatuses including a lickerin and a feeder, the lickerin being configured to remove a plurality of fibers from a fibrous mat delivered to the lickerin by the feeder;

doffing the plurality of fibers from the lickerin at a doffing location within the system;

providing a nose bar assembly extending between a portion of the feeder and the lickerin, wherein the nose bar assembly comprises a curved portion that, with a curvature of the lickerin, forms a passage for the plurality of fibers;

communicating an air supply to entrain the plurality of fibers with the air supply after the plurality of fibers exit the passage, wherein the nose bar assembly is positioned between the lickerin and the air supply;

providing a vent in a saber roll assembly and communicating with the air supply, the saber roll assembly comprising a saber roll and a saber roll end cap, wherein the vent is formed by the saber roll end cap coupled to the saber roll, and wherein the saber roll end cap has a first portion, that receives the saber roll, and a second portion, that defines an edge of the vent; wherein the vent is moveable with movement of the saber roll assembly away from and toward the doffing location, and movement of the saber roll end cap causes a position of the vent to change relative to the lickerin; and collecting the plurality of fibers on the collector from the air supply to form the random fiber web, wherein the collector is a condenser.

2. The method of claim 1, further comprising providing a viewing port in a housing of the pneumatic fiber feeding system, the viewing port allowing for viewing of the doffing location or of a location of the collecting of the plurality of fibers.

3. The method of claim 1, further comprising providing a reverse seal mounted to a lower slide plate, the reverse seal engaging the collector, wherein the reverse seal comprises a tip, and wherein the reverse seal is oriented such that the tip extends in a direction opposite a direction of rotation of the collector.

4. A pneumatic fiber feeding system for forming a random fiber web, the system comprising:

a rotatable feed roll;

a rotatable lickerin roll configured to remove a plurality of fibers from a fibrous mat delivered to the lickerin roll by the feed roll, wherein, as the rotatable lickerin roll rotates, the fibers removed from the fibrous mat are doffed;

a channel communicating an air supply to a space defined between the lickerin roll and a saber roll assembly, the saber roll assembly comprising a saber roll and a saber roll end cap, the space including a doffing location where a doff of the plurality of fibers from the lickerin roll occurs;

wherein the saber roll is positioned adjacent the feed roll and the lickerin roll, and wherein the saber roll is coupled to the saber end cap, the saber end cap being moveable and configured for eccentrically positioning the saber roll within the space, and wherein the saber end cap and the saber roll form a vent that communicates with the channel such that an amount of ambient air can pass therethrough into the channel, wherein the saber end cap has a first portion, that receives the saber roll, and a second portion, that defines an edge of the vent; wherein the vent is moveable with movement of the saber roll assembly away from and toward the doffing location, movement of the saber end cap causes a position of the vent to change relative to the lickerin roll;

a collector positioned to capture the plurality of fibers once doffed into the air supply, the plurality of fibers forming the random fiber web on the collector.

5. The system of claim 4, further comprising a nose bar assembly positioned at least partially between the feed roll and the lickerin roll and extending into the space.

6. The system of claim 5, wherein the nose bar assembly wraps from 1 degree up to 170 degrees of the circumference of the lickerin roll.

7. The system of claim 4, wherein the nose bar assembly has a surface that interfaces with the lickerin roll, and wherein the surface has a texturing to separate the plurality of fibers.

8. The system of claim 4, wherein the nose bar assembly is configured to extend the doffing location past the feed roll and into the space defined between the lickerin roll and the saber roll.

9. The system of claim 4, wherein the saber end cap comprises the vent, and wherein the vent communicates with the channel such that an amount of the air supply can pass therethrough, and wherein the vent comprises an increasing cross-sectional area along a length thereof in a direction of rotation of the saber roll and the saber end cap, and wherein the length of the passage is between 1 degree and 170 degrees of a circumference of the saber roll.

10. A pneumatic fiber feeding system for forming a random fiber web, the system comprising:

a rotatable feed roll;

a rotatable lickerin roll configured to remove a plurality of fibers from a fibrous mat provided, by the rotatable feed roll, to the lickerin roll, and wherein the lickerin roll is then configured to doff the plurality of fibers from the lickerin roll;

a saber roll assembly comprising a rotatable saber roll and a saber roll end cap, the rotatable saber roll positioned adjacent the feed roll and the lickerin roll, the saber roll being received by the saber roll end cap, and wherein the saber roll and the saber roll end cap form a vent that communicates with a channel such that an amount of ambient air can pass therethrough into the channel, and wherein the vent is moveable with movement of the saber roll assembly away from and toward a doffing location where a doff of the plurality of fibers from the lickerin roll occurs, and movement of the saber roll end cap causes a position of the vent to change relative to the rotatable lickerin roll;

the channel being configured to communicate an air supply to a space, the space being defined in part by the lickerin roll and the saber roll;

wherein a condenser is positioned to capture the plurality of fibers once doffed into the air supply, the plurality of fibers forming the random fiber web on the condenser, the condenser configured to rotate in a rotation direction during operation;

a doffer plate and a slide plate, angled relative to each other, that partially define a chamber through which the doffed plurality of fibers travel, the chamber having an increasing cross-section from the lickerin to the condenser; and a seal, mounted to the slide plate and oriented opposite the condenser rotation direction, the seal coupled to an end portion of the slide plate at a mounting portion and extending to contact the condenser, wherein the seal extends from the mounting portion to a tip in a direction opposing the direction of rotation of the condenser.

11. The method of claim 1, wherein a portion of the nose bar assembly extends into a space defined between the lickerin and the saber roll such that the doffing location is in the air supply in the space.

* * * * *